US007850830B2

(12) United States Patent
Richardson et al.

(10) Patent No.: US 7,850,830 B2
(45) Date of Patent: Dec. 14, 2010

(54) METHOD AND APPARATUS FOR RACKING ARTICLES FOR SURFACE TREATMENT

(75) Inventors: Trevor W. Richardson, White Cloud, MI (US); John A. Piselli, Ionia, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 845 days.

(21) Appl. No.: 11/801,807

(22) Filed: May 11, 2007

(65) Prior Publication Data

US 2008/0277286 A1 Nov. 13, 2008

(51) Int. Cl.
*C25D 17/08* (2006.01)

(52) U.S. Cl. ..... 204/213; 204/199; 204/200; 204/212; 204/224 R; 204/288.6; 204/297.01; 204/297.06; 204/297.08; 204/297.09

(58) Field of Classification Search ..... 204/199, 204/200, 212, 213, 224 R, 286.1, 287, 288.6, 204/297.01, 297.06, 297.08, 297.09; 205/128, 205/129, 137, 143, 146, 145, 148, 151, 152
See application file for complete search history.

(56) References Cited

U.S. PATENT DOCUMENTS

| | | | | |
|---|---|---|---|---|
| 1,179,313 | A | 4/1916 | Holden | |
| 1,181,077 | A | 4/1916 | Holden | |
| 1,249,286 | A | 12/1917 | Stone | |
| 1,368,362 | A | 2/1921 | Sill | |
| 1,715,357 | A * | 6/1929 | Hall | 204/202 |
| 1,836,066 | A | 12/1931 | Edison | |
| 1,956,625 | A | 5/1934 | Ritter | |
| 2,505,212 | A | 4/1950 | Schneider | |
| 2,512,642 | A | 6/1950 | Hannon | |
| 2,643,225 | A | 6/1953 | Jones et al. | |
| 3,117,071 | A | 1/1964 | Creese | |
| 3,421,992 | A | 1/1969 | Lazaro | |
| 3,939,054 | A | 2/1976 | Singleton | |
| 4,194,957 | A | 3/1980 | Lipschutz | |
| 4,734,179 | A * | 3/1988 | Trammel | 204/199 |
| 4,740,285 | A | 4/1988 | Akiyama | |
| 4,946,572 | A | 8/1990 | Hickey | |
| 4,946,573 | A | 8/1990 | Weng | |
| 4,992,145 | A | 2/1991 | Hickey | |
| 5,360,527 | A * | 11/1994 | Ribitch | 204/297.08 |
| 5,391,277 | A | 2/1995 | Weng | |
| 5,435,457 | A | 7/1995 | Tiner et al. | |
| 5,670,034 | A | 9/1997 | Lowery | |
| 6,001,235 | A | 12/1999 | Arken et al. | |
| 6,543,631 | B1 * | 4/2003 | Sawyers | 211/205 |
| 7,097,749 | B2 * | 8/2006 | Donovan et al. | 204/297.07 |
| 2002/0134673 | A1 | 9/2002 | Weng | |
| 2005/0279642 | A1 | 12/2005 | Brondum | |

FOREIGN PATENT DOCUMENTS

| | | |
|---|---|---|
| FR | 2142094 | 1/1973 |
| GB | 1166535 | 10/1969 |
| JP | 1004499 | 1/1989 |

* cited by examiner

*Primary Examiner*—Bruce F Bell
(74) *Attorney, Agent, or Firm*—Price, Heneveld, Cooper, DeWitt & Litton LLP

(57) ABSTRACT

A process employing a rack having an article carrier that is movably supported on a frame and mechanically coupled for translating movement from a motor to the article carrier to effect movement of an article during processing to provide more uniform surface treatment, reducing or eliminating the need for shielding.

5 Claims, 3 Drawing Sheets

METHOD AND APPARATUS FOR RACKING ARTICLES FOR SURFACE TREATMENT

FIELD OF THE INVENTION

This invention relates to surface treatment generally, and more particularly to uniform surface treatment of contoured articles having curved surfaces, sharply angled surfaces, or both.

BACKGROUND OF THE INVENTION

Shown in FIG. 1 is a typical rack 10 known to the inventors for electroplating articles such as to deposit a layer of chrome on a plastic automotive component. Rack 10 includes a plurality of part-gripping elements 12 for holding articles 14 during an electroplating process. Rack 10 is provided with an electrically insulative coating (e.g., a plastic coating) that covers an electrically conductive frame, so that generally all surfaces of the electrically conductive frame that are submerged in an electrolyte during an electroplating process are covered, such that the only electrically conductive components of the rack exposed to the electrolyte are typically the part-gripping elements 12, which in addition to holding articles 14 are electrically connected to articles 14 to conduct current from the articles, through the frame of rack 10 and to a rail 20 from which rack 10 is suspended by electrically conductive hooks 25.

During the electroplating process, metal ions are released into the electrolyte from an anode material that is in contact with the electrolyte and migrate toward and become deposited on exposed surfaces of the articles 14 that are being electroplated. A net movement or flux of metal ions from the anode to articles 14 (which are made cathodic) is driven by an electrical potential between the anode and articles 14.

In a conventional electroplating process using rack 10, articles 14 are held in a stationary position relative to rail 20, rack 10 and a container or vessel holding an electrolyte. In such processes, there is a tendency for plating deposits to be thicker at sharp edges and corners. These heavier deposits of plating material at the edges and corners of the articles being plated forms aesthetically undesirable, non-uniformly thick features. In order to reduce or eliminate this problem and provide more uniform coating thicknesses at sharp edges and/or corners, shielding, such as ledges 30, 32 are provided adjacent the sharp edges of articles that are to be electroplated such as the upper and lower edges of articles 14. The design of appropriate shielding for any particular article having a selected orientation on an electroplating rack is both an art and a science that often requires considerable intuition and/or trial and error. Accordingly, it would be desirable to develop an electroplating rack and process in which the difficulties associated with designing appropriate shielding to reduce non-uniform plating at sharp edges and corners of articles could be eliminated or at least significantly reduced. In addition, by eliminating or at least substantially reducing the need for shielding, the cost of making and repairing electroplating racks would be reduced. For example, it is not uncommon for an electrically insulative coating on an electroplating rack 10 to develop a hole or other imperfection that allows chrome or other plating material to deposit on the rack rather than only on articles 14. In such case, it is generally necessary to completely remove the defective electrically insulative coating from the electroplating rack and apply a new insulative coating. The difficulty and cost associated with this type of repair can be substantially reduced if the shielding, and hence the electrically insulative coating on the shielding, could be eliminated.

SUMMARY OF THE INVENTION

An electroplating rack in accordance with certain aspects and embodiments of the invention includes a frame configured to support an article carrier for movement relative to the frame, whereby articles supported on the carrier are moved through an electrolyte during electroplating.

In accordance with certain preferred embodiments, an electroplating rack includes a frame having a member for suspending the frame in an electroplating bath, an article carrier that is movably supported on the frame, and a mechanical coupling for translating movement of an output from a motor to the article carrier to effect movement of the article carrier relative to the frame and the electrolyte when the frame is partially submerged in an electrolyte during an electroplating process.

These and other features, advantages and objects of the present invention will be further understood and appreciated by those skilled in the art by reference to the following specification, claims and appended drawings.

DETAILED DESCRIPTION OF PREFERRED EMBODIMENT(S)

Figure 1:
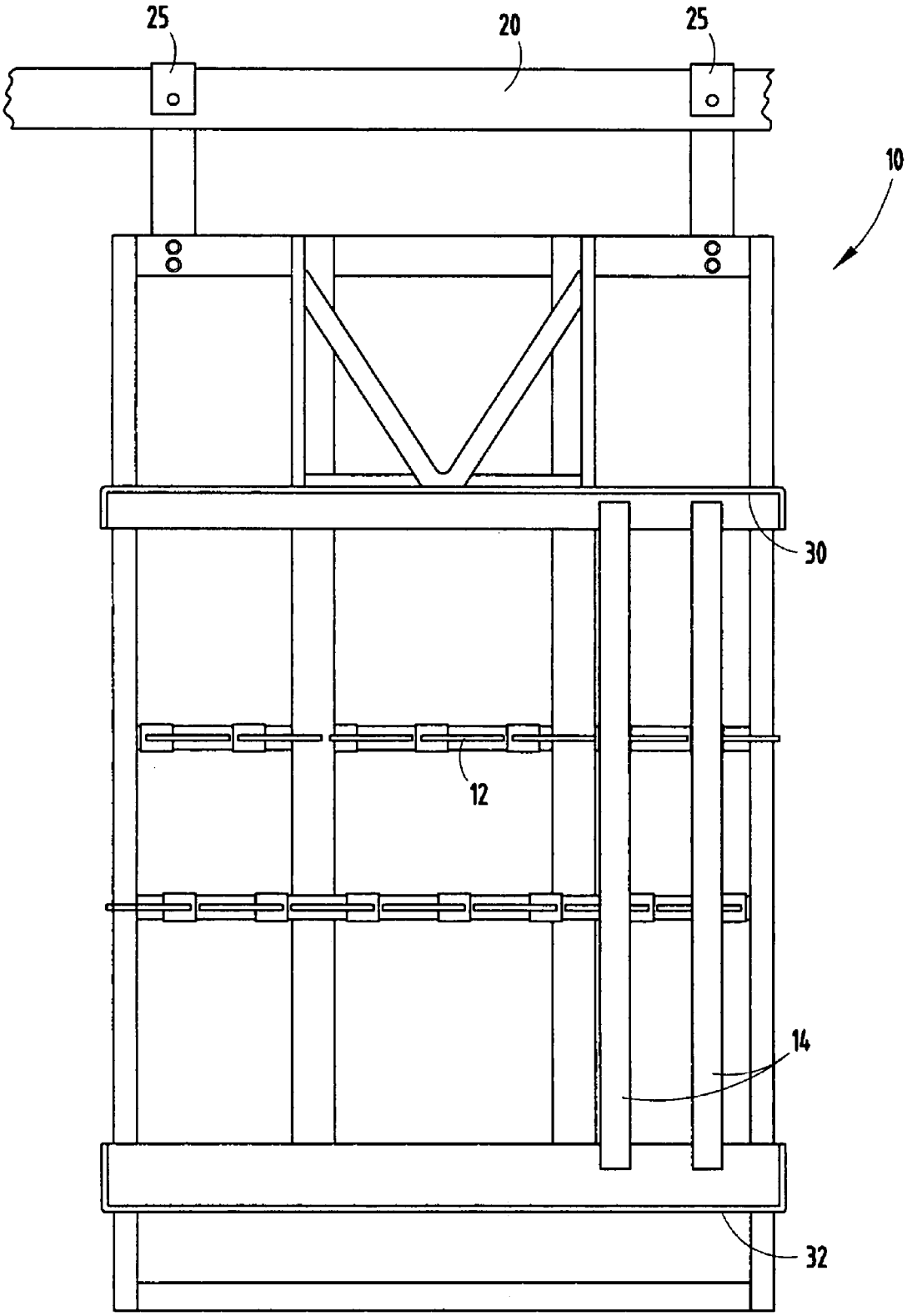
FIG. 1 PRIOR ART
FIG. 1 is a front elevational view of a known plating rack used for supporting articles that are to be electroplated in an electrolyte during an electroplating process.
Figure 2:
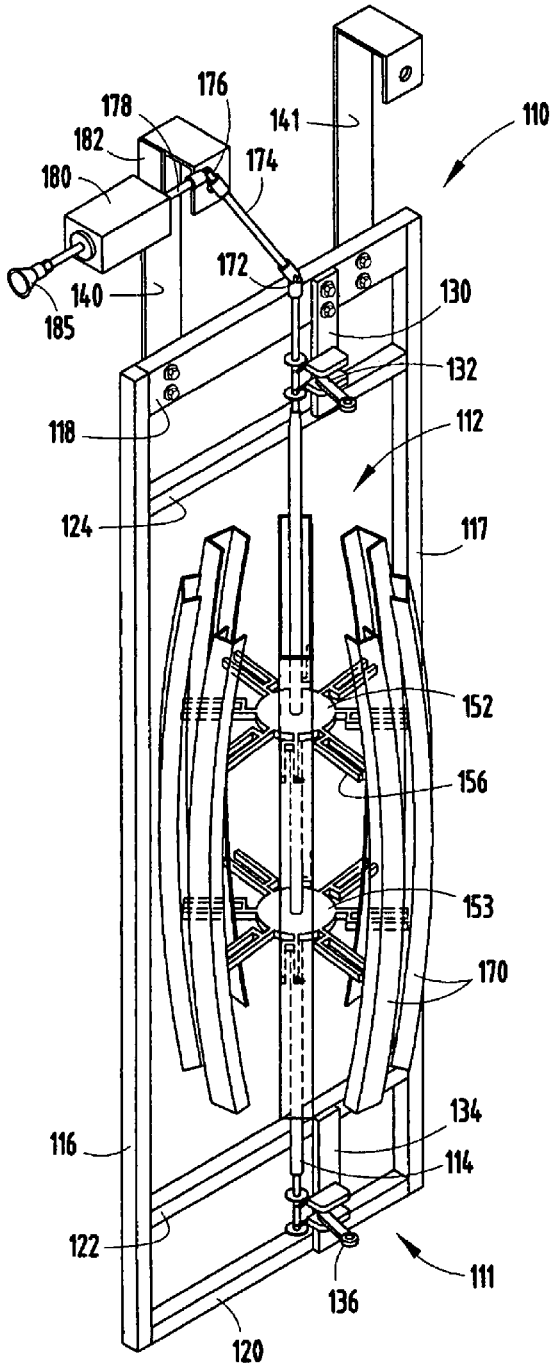
FIG. 2 is a perspective view of an embodiment of the electroplating racks of the invention.
Figure 3:
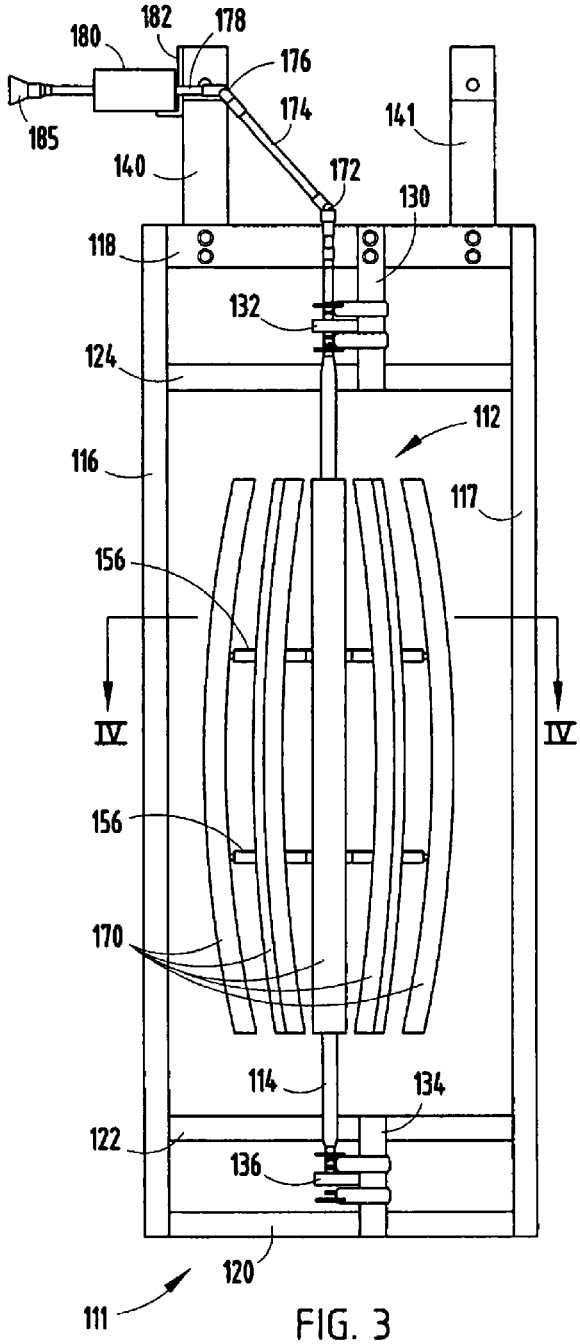
FIG. 3 is front elevational view of the electroplating rack shown in FIG. 2.
Figure 4:
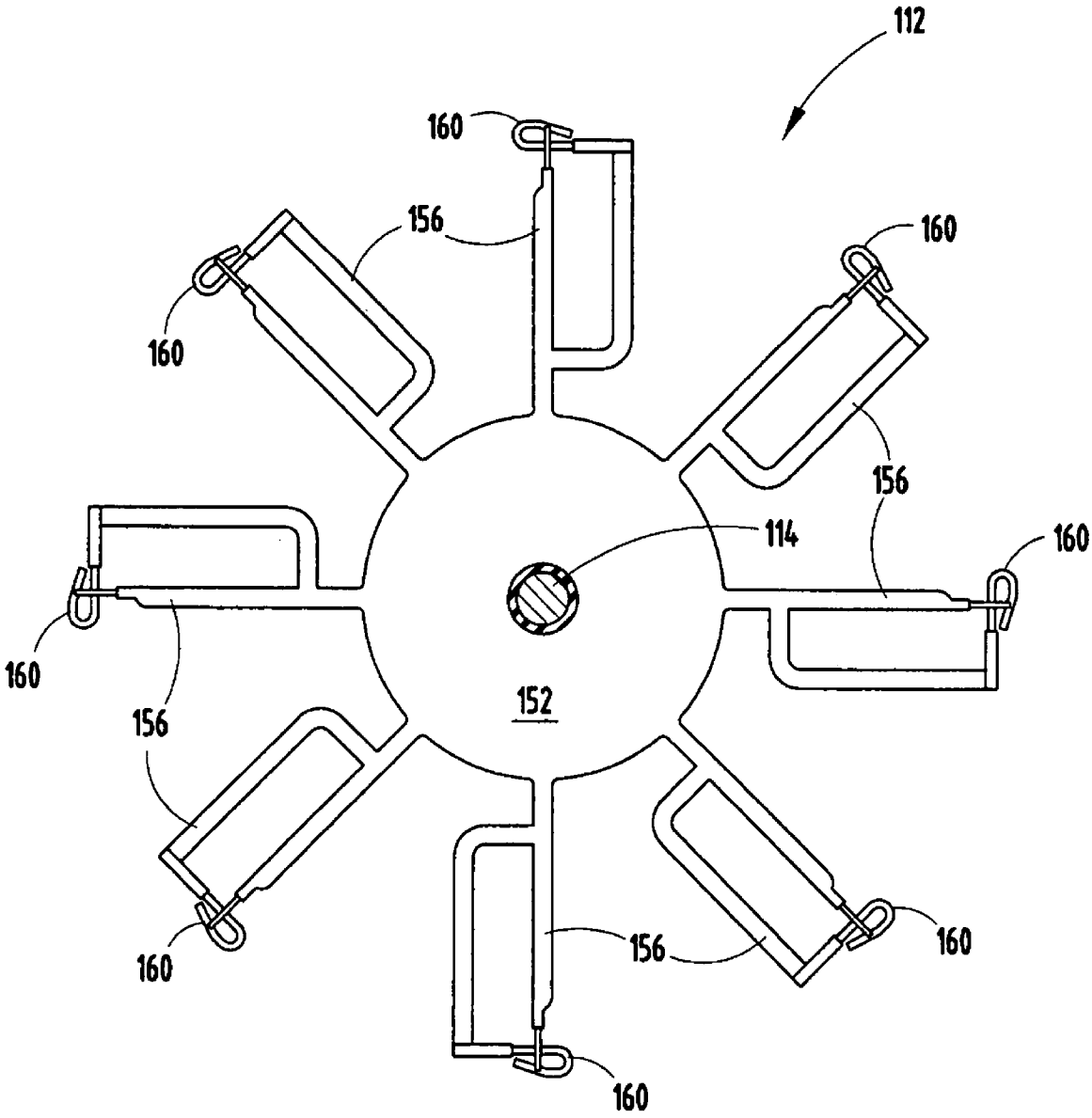
FIG. 4 is a top view of an article carrier that is rotatably supported on the electroplating rack shown in FIGS. 2 and 3.

Electroplating rack 110 has a frame 111 and an article carrier 112 supported on frame 111 for rotational movement of a shaft or axle 114.

Illustrated frame 111 includes a generally rectangular structure defined by vertically arranged side members 116 and 117, a horizontally arranged top member 118, and a horizontally arranged bottom member 120. Spaced upwardly away from bottom member 120 is a lower reinforcing member 122 extending horizontally between and connected to side members 116 and 117. Spaced downwardly away from top member 118 is an upper reinforcing member 124 extending horizontally between and connected to side members 116 and 117. An upper journal support member 130 is affixed at its opposite ends to top member 118 and upper reinforcing member 124. Attached to upper journal support member 130 is an upper journal mechanism 132 for supporting an upper portion of shaft or axle 114 of article carrier 112 for rotation. In a preferred embodiment, shaft 114 and hence article carrier 112 is releasably supported by journal mechanism 132. A lower journal support member 134 is affixed at its opposite ends to bottom member 120 and lower reinforcing member 122. Attached to lower journal support member 134 is a lower journal mechanism 136 for supporting a lower portion of shaft or axle 114 of article carrier 112 for rotation. In a preferred embodiment, shaft 114 is releasably and rotationally supported by lower journal mechanism 136.

Extending upwardly away from top member 118 are a pair of members or hooks 140 and 141 that are provided to suspend electroplating rack 110 in an electroplating bath. It is conceivable that more or fewer hooks could be employed. For example, a single hook extending upwardly from approximately the center of top member 118 could suffice in some circumstances. In addition to supporting electroplating rack 110, hooks 140 and 141 are electrically connected to rail 20 and conduct electrical current from rack 110 to rail 20.

Members 116, 117, 118, 120, 122, 124, 130 and 134 are typically made of steel. However, the structural members of frame 111 may be made of other electrically conductive materials. Hooks 140 and 141 are typically made of copper alloy. In order to prevent metal from being plated onto the structural components of frame 111, at least those portions of frame 111 that are submerged in electrolyte during an electroplating operation are coated with an electrically insulative material (typically a plastic coating).

Article carrier 112 includes a central vertical shaft or axle 114 rotatably supported on journal mechanisms 132 and 136. In addition to supporting axle 114 for rotation, journal mechanisms 132 and 136 are also designed to conduct electrical current from axle 114 through frame 111 to rail 20.

In the illustrated embodiment, vertically spaced apart hubs 152 and 153 are provided on axle 114. Projecting radially away from hubs 152 and 153 at uniformly spaced apart angles are a plurality of arms 156. Carried at the distal ends of arms 156 are electrically conductive article gripping elements 160. The electrically conductive article gripping elements 160 hold articles that are to be electroplated and conduct electrical current from the articles through arms 156, axle 114, journal mechanisms 132 and 136, and frame 111 to rail 20. Fewer or more hubs and/or arms may be used as desired depending on the types of articles that are to be electroplated.

As with the members of frame 111, axle 114, hubs 152 and 153, and arms 156 are typically made of steel, but other electrically conductive materials could be employed. Also, as with frame 111, at least substantially all of the portions of article carrier 112 that are submerged in electrolyte during electroplating are coated with an electrically insulative material (e.g., plastic), except for the gripping elements 160 (which must make electrical contact with the articles 170 being electroplated). This prevents plating of materials onto the rack components, and reduces the need for employing expensive plating removal techniques.

At an upper end of axle 114 is a first universal joint 172 that translates rotational movement of an intermediate shaft 174 to axle 114, and at a distal end of intermediate shaft 174 is a second universal joint 176 that translates rotational movement of input shaft 178 to intermediate shaft 174. Input shaft 178 is journaled in a stationary journal mechanism 180 fixed to hook 140 by bracket 182 in order to hold input shaft 178 in a translationally fixed position relative to electroplating rack 110. At a distal end of input shaft 178 is a coupler 185 for connecting input shaft 178 to an output shaft (not shown) from a motor (e.g., an electrical motor) mounted at or near the top of an electroplating bath. In accordance with a preferred aspect of the invention, coupler 185 is a quick-connect type coupling that achieves a suitable mechanical connection with relatively little effort and preferably without tools. Other mechanical linkages, transmissions and the like for transmitting rotational movement from an output shaft of a motor to the input shaft 178 or directly to axle 114 may be employed as an alternative (e.g., a flexible drive shaft).

Improved aesthetics are typically achieved using the processes and apparatuses of the invention. More specifically, employment of the processes and apparatuses of the invention generally provide electroplated articles having a smoother surface with fewer, if any, speckles or other localized discolorations or surface imperfections. It is believed that the improved aesthetics are achieved because movement prevents suspended particulates from setting on surfaces on the article during electroplating.

In accordance with another aspect of the invention, an improved method of electroplating an article is provided. The improved method involves providing an electroplating rack having a frame and an article carrier rotatably supported on the frame. At least one article that is to be electroplated is mounted on the article carrier. The electroplating rack with the at least one article mounted on the article carrier is at least partially submerged in an electroplating bath, which includes an electrolyte and an anode. The anode is comprised of a material that is to be electroplated onto a surface of the article, and the anode is in contact with the electrolyte. The article supported on the article carrier is typically completely submerged in the electrolyte. The article carrier is rotated to move the article through the electrolyte, and an electrical potential is applied between the article and the anode to cause material from the anode to become deposited on the surface of the article. While it is envisioned that rotation of the article carrier and application of the electrical potential would typically occur concurrently, certain benefits of the invention may be achieved by rotating the article carrier in the electroplating bath and applying an electrical potential between the article and the anodes sequentially, such as by rapidly alternating between rotating the article carrier and applying an electrical potential and/or using a pulse plating technique.

The methods and apparatuses of the invention generally eliminate or reduce burning and treeing during electroplating (phenomenon that tend to occur at sharp corners that are exposed to a high current density). It is believed that using the processes and apparatuses of the invention provides more moderate time averaged current densities resulting from movement of all surfaces of the article being electroplated relative to the anode material.

Movement of the articles through the electrolyte prevents or at least reduces excessive buildup of non-uniformly thicker electroplate deposits at edges and corners. A suitable linear or tangential speed for the surfaces of the articles that are being electroplated relative to the electrolyte can vary depending on other process parameters (e.g., about 10 cm per minute to about 10 meters per minute). Significantly higher speeds are possible but are unnecessary and could be undesirable, and significantly lower speeds may not provide adequate benefits.

Although it is envisioned that the most practical and economical way of achieving the benefits of the invention is by rotational movement of an article carrier in an electroplating bath, similar benefits may be achieved using translational movement of the article or article carrier through an electroplating bath or using a combination of both translational and rotational movement. Pneumatic or hydraulic cylinders may be employed, for example, to achieve reciprocating linear or translational movement of the article carrier and articles that are being electroplated. The carrier may be configured for rotation around and/or translational movement along any axis or direction.

Advantages of the apparatus and methods of this invention include elimination or reduction of the need for shielding, resulting in lower cost electroplating racks and lower costs associated with repair of electroplating racks. The apparatus and method of the invention provide more uniformly thick plating on all surfaces of an article including those articles having surfaces that are angled with respect to each other. In the illustrated embodiment, removeability of the rotating article carrier from the rack facilitates greater flexibility for using the rack frame with different article carriers or using the article carriers with different rack frames to allow greater flexibility in configuring electroplating racks for use with different size electroplating tanks or baths.

The above description is considered that of the preferred embodiment(s) only. Modifications of the invention will occur to those skilled in the art and to those who make or use the invention. Therefore, it is understood that the embodiment (s) shown in the drawings and described above are merely for illustrative purposes and not intended to limit the scope of the invention, which is defined by the following claims as interpreted according to the principles of patent law, including the doctrine of equivalents.

The invention claimed is:

1. An electroplating rack comprising;

a frame;

at least one electrically conductive hook extending upwardly from the frame to facilitate suspension of the frame from a rail;

an article carrier moveably supported on the frame, the article carrier including a shaft rotatably supported on the frame by a lower journal mechanism located adjacent a lower end of the frame and an upper journal mechanism located adjacent an upper end of the frame; and a mechanical linkage for transmitting movement from a motor to the article carrier to effect relative movement of the article carrier with respect to the frame, whereby articles mounted on the article carrier are moveable through an electrolyte in an electroplating bath when the electroplating rack is positioned with the article carrier submerged in the electrolyte.

2. The electroplating rack of claim 1, wherein the article carrier further comprises a plurality of arms extending radially away from the vertically oriented axle at spaced apart angles, the distal ends of the arms carrying an article-gripping element for physically and electrically attaching articles that are to be electroplated to the electroplating rack.

3. The electroplating rack of claim 1, wherein lower portions of the frame and article carrier which are to be submerged during electroplating of articles are coated with an electrically insulative material.

4. An electroplating rack comprising:

a frame having at least one member for suspending the frame in an electroplating bath, the frame having an electrically insulative coating to prevent metal from plating on surfaces of the frame suspended in an electrolyte during an electroplating process;

an article carrier moveably supported on the frame; and a mechanical linkage for transmitting movement from a motor to the article carrier to effect relative movement of the article carrier with respect to the frame, whereby articles mounted on the article carrier are moveable through an electrolyte in an electroplating bath when the electroplating rack is positioned with the article carrier submerged in the electrolyte;

wherein the article carrier includes a shaft rotatably supported on the frame by a lower journal mechanism located adjacent a lower end of the frame and an upper journal mechanism located adjacent an upper end of the frame.

5. An electroplating rack comprising:

a frame having at least one member for suspending the frame in an electroplating bath, the frame having a generally rectangular structure defined by vertically arranged side members, a horizontally arranged top member, and a horizontally arranged bottom member;

an article carrier movably supported on the frame; and a mechanical linkage for transmitting movement from a motor to the article carrier to effect relative movement of the article carrier with respect to the frame, whereby articles mounted on the article carrier are movable through an electrolyte in an electroplating bath when the electroplating rack is positioned with the article carrier submerged in the electrolyte, wherein the article carrier includes a shaft rotatably supported on the frame by a lower journal mechanism located adjacent a lower end of the frame and an upper journal mechanism located adjacent an upper end of the frame.

* * * * *

UNITED STATES PATENT AND TRADEMARK OFFICE

CERTIFICATE OF CORRECTION

PATENT NO. : 7,850,830 B2
APPLICATION NO. : 11/801807
DATED : December 14, 2010
INVENTOR(S) : Richardson et al.

It is certified that error appears in the above-identified patent and that said Letters Patent is hereby corrected as shown below:

Column 2
Line 33, “is front” should be --is a front--.

Column 5
Claim 1, line 17, “comprising;” should be --comprising:--.

Column 6
Claim 5, line 35, “electrolyte,” should be --electrolyte;--.

Signed and Sealed this
Fifteenth Day of March, 2011

David J. Kappos

David J. Kappos
*Director of the United States Patent and Trademark Office*